US011659910B2

(12) United States Patent
Kumar et al.

(10) Patent No.: US 11,659,910 B2
(45) Date of Patent: May 30, 2023

(54) NAIL AND FOOT CARE APPARATUS

(71) Applicants: Amit Kumar, Chino Hills, CA (US); Sumit Kumar, New Delhi (IN)

(72) Inventors: Amit Kumar, Chino Hills, CA (US); Sumit Kumar, New Delhi (IN)

( * ) Notice: Subject to any disclaimer, the term of this patent is extended or adjusted under 35 U.S.C. 154(b) by 0 days.

(21) Appl. No.: 17/231,045

(22) Filed: Apr. 15, 2021

(65) Prior Publication Data

US 2021/0227949 A1 Jul. 29, 2021

Related U.S. Application Data

(63) Continuation-in-part of application No. 16/698,923, filed on Nov. 27, 2019, now abandoned.

(51) Int. Cl.
*A45D 29/02* (2006.01)

(52) U.S. Cl.
CPC ..... *A45D 29/023* (2013.01); *A45D 2029/026* (2013.01)

(58) Field of Classification Search
None
See application file for complete search history.

(56) References Cited

U.S. PATENT DOCUMENTS

| | | | | |
|---|---|---|---|---|
| 6,832,688 | B1 * | 12/2004 | Rivera | A45D 29/20 132/288 |
| 9,723,930 | B2 | 8/2017 | Burch et al. | |
| 10,918,215 | B1 | 2/2021 | Berger | |
| 11,103,042 | B1 * | 8/2021 | Smith | A45D 29/18 |
| 2006/0273084 | A1 * | 12/2006 | Baker | B65D 51/00 220/23.4 |
| 2008/0296447 | A1 * | 12/2008 | Peterson | A61B 17/54 248/171 |
| 2015/0351516 | A1 * | 12/2015 | Doff | A45D 29/20 132/200 |
| 2018/0235342 | A1 * | 8/2018 | Wesley | A47B 5/04 |
| 2018/0344000 | A1 * | 12/2018 | Humphrey | A45D 29/20 |

* cited by examiner

*Primary Examiner* — Erica S Lin
(74) *Attorney, Agent, or Firm* — R. Keith Harrison

(57) ABSTRACT

An illustrated view of an exemplary nail and foot care apparatus for foot maintenance and treatment is presented. The footcare apparatus 100 comprises a support stand 200, a footrest 300, a tray 400, a storage box 510, one or more battery banks 520, a light 530, a fan 540, a mobile holder 423. The footrest, the tray, the storage box, the battery banks, the light, and the fan are configured to detachably coupled together and rest on the adjustable, foldable support stand. The footcare apparatus provides convenient access to foot and toes part, without the help of others. It can be used for treatment of the foot and leg of a patient at hospital and clinics. Enables easy cleaning of the clippings, treatment wastes with detachable tray. It is provided with number of storage options during and after use, to keep the pedicure tools, cosmetics and electronic gadgets.

19 Claims, 5 Drawing Sheets

NAIL AND FOOT CARE APPARATUS

CROSS-REFERENCES TO RELATED APPLICATIONS

This application is a Continuation-in-part of co-pending U.S. application Ser. No. 16/698,923 filed on Nov. 27, 2019, herein incorporated by reference in its entirety.

FIELD OF THE INVENTION

This invention relates to nail and foot care apparatus for use in foot maintenance. More particularly, it relates to portable, foldable, adjustable, self-standing, ergonomically designed for foot and toenail maintenance at comfort without assistance from others.

BACKGROUND OF THE INVENTION

Access to one's own foot and toenails is always not easy. However, the maintenance or taking care of the fingernails and toenails, is important for health as well as for cosmetic reasons. Good nail care can prevent fungus infections of the nail, painful ingrown in fingernails and toenails, and infections of the skin in the hands and feet. Nail care is especially important for those with diabetes, as infections of the feet are dangerous.

Taking good care of nails by keeping them short and trimmed, in the shape of straight across for toenails, and keeping clean is very essential to ward off calluses, athletes' foot and other problems.

Nail grooming also plays an important role in maintaining high self-esteem and self-confidence, shows professionalism in workplace, influences individual emotions, enhances beauty, health, and hygiene.

Centre for disease control and preventions, recommends proper nail hygiene to prevent some of the infections such as pinworms, as longer nails can harbor more dirt and bacteria/germs than shorter nails.

The best way to care for nails is to trim them regularly. Filing or grooming is also recommended, as to keep nails from becoming too rough and to remove any small bumps or ridges that may cause the nail to get tangled up in materials such as cloth. Further a properly trimmed toenails avoids painful problems like hangnails and jagged edges.

Beauty conscious people polish and color the nails to match occasion or the dress they wore. It is very delicate art and tedious activity to do without easy access to tools, polishing, polishing material and stand to rest the foot comfortably at home as compared to get it done at Saloon.

Even it is more difficult for the people who are of an older age, disabled or unable to fully reach their toes in normal situations when they need to have their toenails clipped, trimmed, groomed, painted/polished and, they are unable or at the needs of others to trim their toenails. This can cause many of the issues when they do not take proper care of their toenails.

It is also observed and received the concerns, that access to foot and leg of a person by health care workers while treating patients in hospital at right postures is an issue. Specially treating foot, toes, heels, and nearby parts, for activities like medication, physiotherapy, managing bandages and plaster casts etc., An easy, and convenient access for treatment and comfortable posture for patients are critical for proper treatment, thereby minimizing on ergonomic concerns for both care givers and patients.

Accordingly, there is a need exists for an apparatus to aid those individuals who want to cut, or groom or polish, or paint their toenails at home comfort, without going to expensive saloon, which provides not only resting the foot at comfortable position, but also easy access to toenails, tools, paints, proper lighting, and curing, with easy collection of clipped nails for safe disposal. Further need in clinics and hospitals to ease of access to foots and leg for treatments.

SUMMARY OF THE INVENTION

The present disclosed invention, a nail and foot care apparatus is useful for number of applications, which enables easy, convenient, and comfortable access to foot and toes. With adjustable height and tilt, it can be used, including but not limited to nail clippings, nail grooming, foot treatments, wearing footwears, tying lace, etc., at home comfort without the help or aid by other people and treatment for foot and legs at clinics and hospitals.

The disclosed nail and foot care apparatus comprises a support stand, a footrest, a tray. Further the nail and foot care apparatus is provided with accessories, including but not limited to a storage box, one or more battery bank, a light with magnifying lens, a fan, a mobile holder and so on.

In one of the embodiments, the top of the footrest of the nail and foot care apparatus is configured to accommodate a foot of a person. A heel of the foot of the person is positioned to be substantially near the first end. Toes of the foot of the person is positioned to be substantially near the second end. The footrest is tilted such that the first end of the footrest is at least closer to a ground or floor than the second end. Further, the first end of the footrest has an arch shaped heel rest to accommodate the rotation of the foot, while still supporting the leg and foot.

The bottom of the footrest is coupled to the support stand. The support stand comprises the first leg set and the second leg set, the first leg set is attached to the height adjustable device which is fixed, substantially closure to the second end of the of the bottom of the footrest. The second leg set is pivotally fixed at the first end of the footrest. The first leg set, and second leg set are pivotally coupled to make a cross, to enable the support stand firmly to hold the footrest. The first leg set is comparatively longer the second leg set, to inherently provide the tilt for the footrest. The tilt and the height are further adjustable with setting the tilt or height adjusting device with the top end of the first leg set.

Further the footrest is provided with side grooves or slots, extended on both side of the footrest, to place the pedicure tools for easy access during the nail and footcare process. The grooves are wide enough to hold commonly used pedicure tools like nail clippers, nail filer etc. Further the side grooves are provided with one or more holes or openings to store additional pedicure tools.

In another the embodiment, the nail and foot care apparatus is provided with a tray, which is removably attached to the second end of the footrest and configured to catch the nail and cuticle while cutting. Another part of the tray is configured to place nail grooming cosmetic bottles like, polish paint, etc., and are accessible easily. Further one part of the tray is configured to hold the smart device like mobile phone, tabs mobile battery bank etc., In another embodiment the footrest apparatus is provided with storage box, for storing pedicure tools—filer, nail cutter, cuticle cutter, flashlight, fan and so forth. The storage box is removably clips on to the heel rest of the footrest.

In another embodiment, one or two battery banks are provided, which are slidable into battery bank slots under the tray. The slots are designed to securely hold the battery banks. The battery banks are connected to power the fan and light which van be focused to foot care area. The battery banks are removable sliding back conveniently over the ribs of the battery bank slots to replace batteries in the battery bank or for cleaning the tray.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and the other features, aspects, and advantages of the present disclosure will become better understood with regard to the following description, appended claims, and accompanying drawings, the drawings described herein are for illustrative purpose only of the selected embodiments and not all possible implementations and are not intended to limit the scope of the present disclosure.

DETAILED DESCRIPTION OF THE INVENTION

Figure 1:
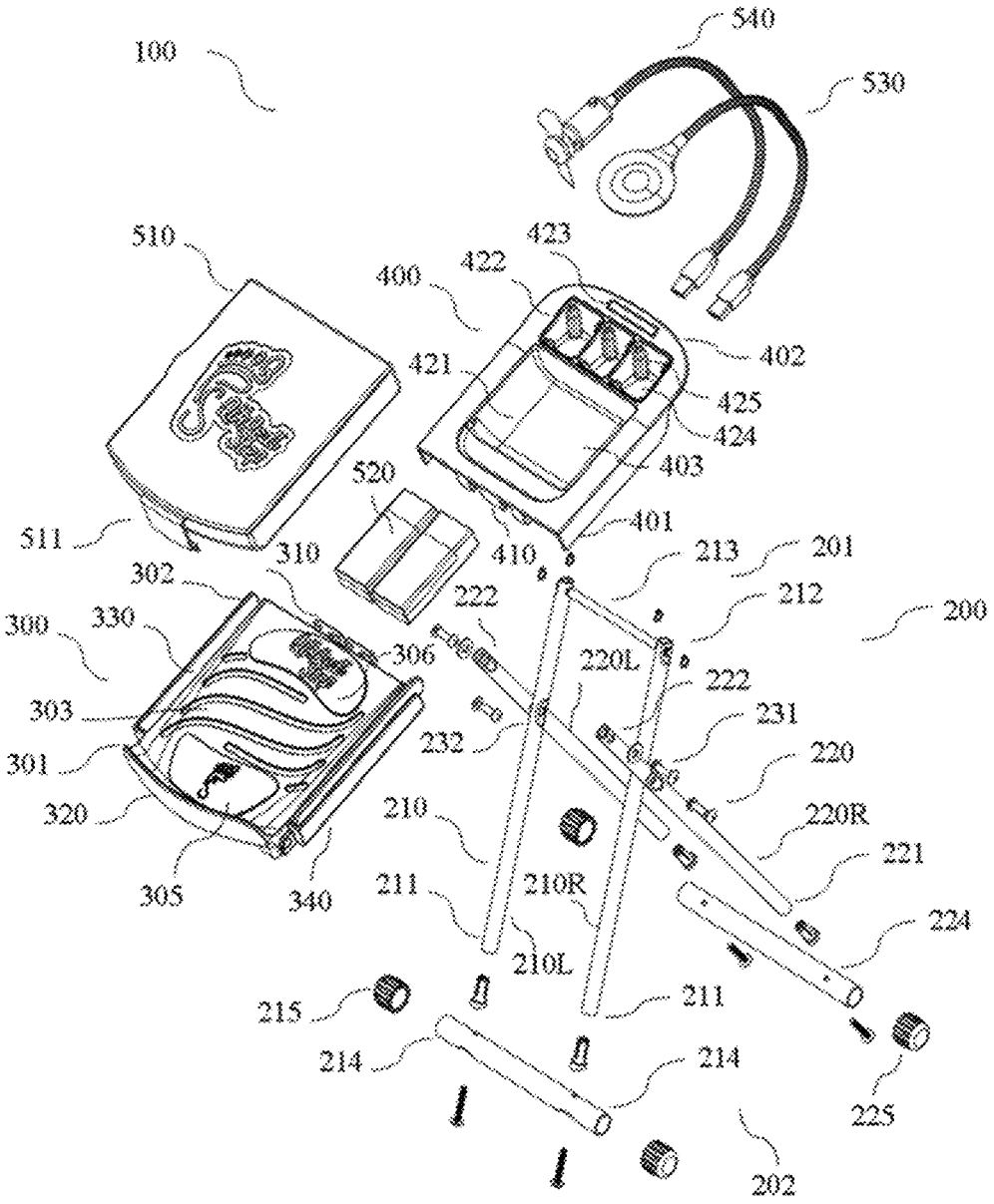
FIG. 1 is an illustrated exploded view of an exemplary foot care apparatus 100.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications, and equivalents. In alternate embodiments, additional devices, or combinations of illustrated devices, may be added to, or combined, without limiting the scope to the embodiments disclosed herein.

The present disclosed invention, a nail and foot care apparatus may be used for number of applications, which enables easy, convenient, and comfortable access to foot and toes with adjustable height and inclination or tilt, including but not limited to foot maintenance, nail clippings, nail grooming, foot treatments, wearing footwears, tying laces, etc., at home comfort without the help or aid by other people. The nail and foot care apparatus has many features that include, but are not limited to: foldable leg system, with height and inclination/slope adjustable options, detachable tray portion with nail and cuticle collecting compartment for collection and easy disposal of them, storage compartment for nail grooming cosmetics like nail paint, polish, paint remover, storage side slots or grooves for tools like clippers, files, scissors, detachable battery bank with power ports to supply power to fans, lights and electric tools, separatable storage box to store the tools and cosmetics during and after use. Options to hold smart devices like mobile phone, tablets, and mobile battery bank etc., optionally the mobile battery bank may be used to power the fans, lights, and power tools, for foot care. Persons having ordinary skill in the art relevant to the present disclosure understand that there may be equivalent elements that may be substituted with those described within the present disclosed invention for foot care apparatus.

Referring to FIG. 1, an exploded view of an exemplary nail and foot care apparatus 100 for foot maintenance is presented. Foot care and nail maintenance being the lifelong activity, the nail and foot care apparatus 100 is useful for providing a user with a feeling of independence, increased self-esteem, and satisfaction without the need to rely on others. Further, the nail and foot care apparatus 100 is useful for not only helping to keep the health of the user's toenails but also to provide an apparatus that makes clean up and finding of the clipped toenails easy, efficient, and timely.

Referring to FIG. 1, the nail and foot care apparatus 100 comprises a support stand 200, a footrest 300, a tray 400, a storage box 510, one or more battery banks 520, a light with magnifying lens 530, a fan 540, a mobile holder 423, wherein the footrest 300, the tray 400, the storage box 510, the battery banks 520, the light 530 and the fan 540 are configured to detachably coupled together and rest on the adjustable, foldable support stand 200.

The footrest 300 further comprises a first end 301, a second end 302, a top 303 and a bottom 304. The first end 301 of the footrest 300 has a heel rest 320. The heel rest 320 is arch shaped to accommodate the rotation of the foot at the knee, while still supporting the leg and foot.

In another embodiment, the heel rest 320, is configured to couple at the first end 301 of the footrest 300, pivotally, to fold the heel rest while storing the nail and foot care apparatus 100.

In another embodiment, the heel rest 320, is configured to couple removably at the first end 301 of the footrest 300.

The second end 302 of the footrest 300 is provided with a male tab 310, configured to removably couple the tray 400 with a press fit action.

Figure 2:
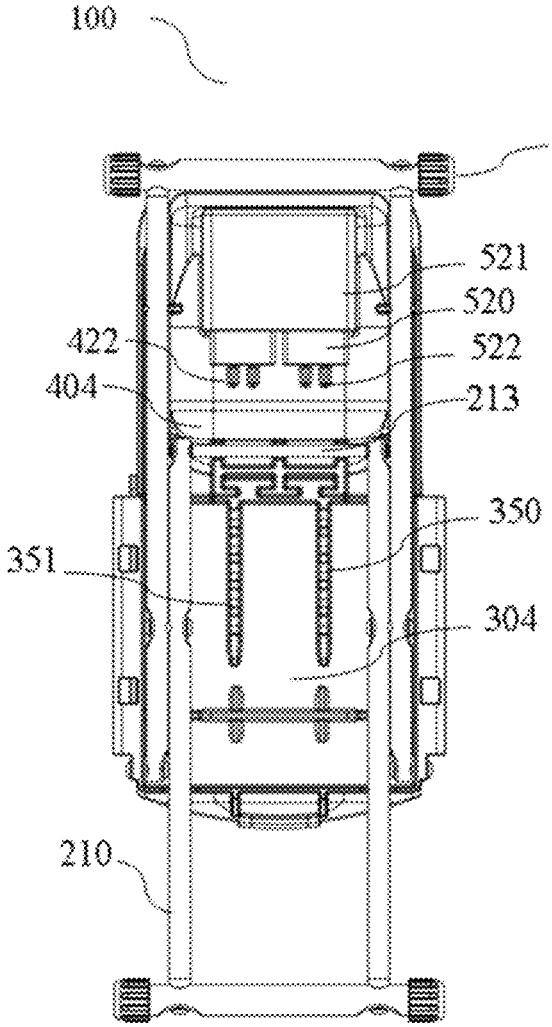
FIG. 2 is an illustrated bottom view in folded form of an exemplary foot care apparatus 100.
Figure 3:
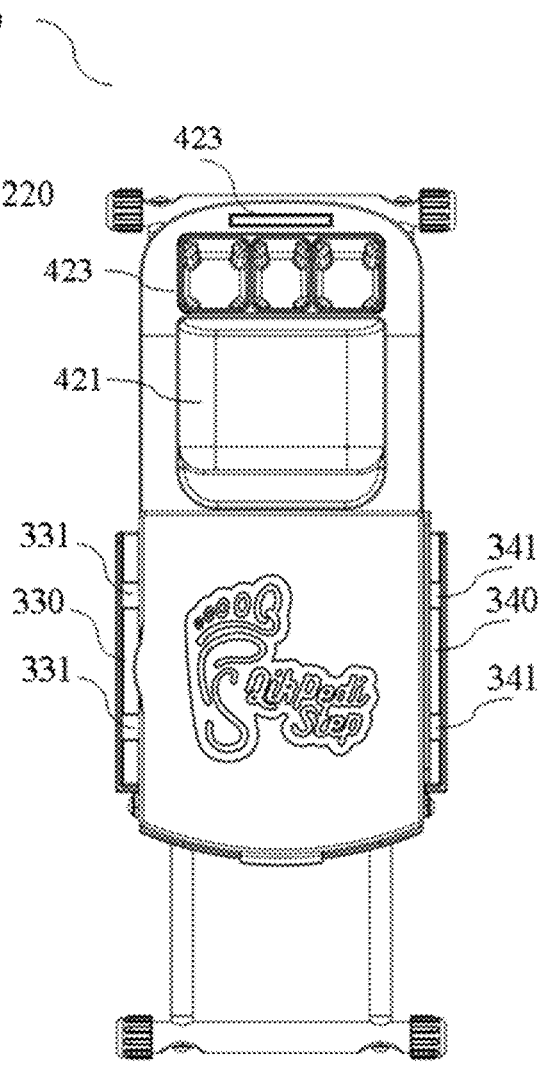
FIG. 3 is an illustrated top view in folded form of an exemplary foot care apparatus 100.
Figure 4:
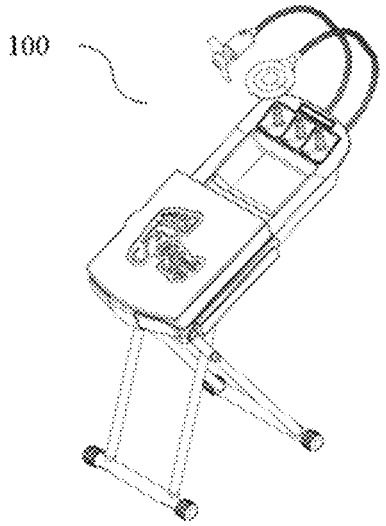
FIG. 4 is an illustrated isometric top view in unfolded form of an exemplary nail and foot care apparatus 100.
Figure 5:
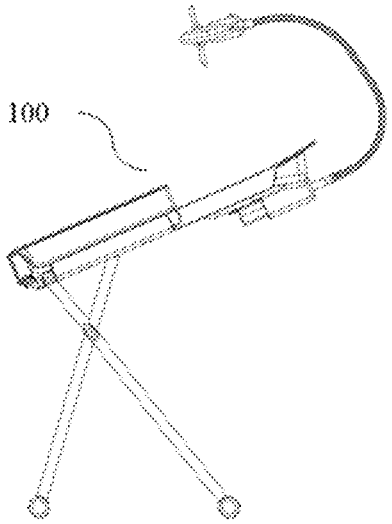
FIG. 5 is an illustrated side view in unfolded form of an exemplary foot care apparatus 100.
Figure 6:
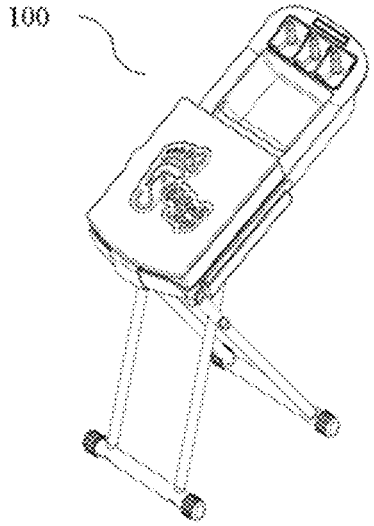
FIG. 6 is an illustrated isometric top view of an exemplary foot care apparatus 100 in unfolded form of an exemplary nail and foot care apparatus without light and fan.
Figure 7:
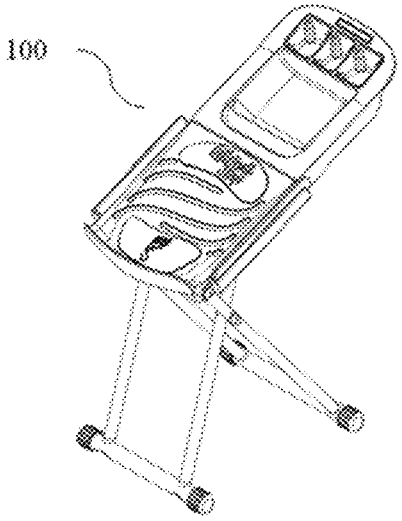
FIG. 7 is an illustrated isometric top view of an exemplary foot care apparatus 100 in unfolded form of an exemplary nail and foot care apparatus without light, fan, and storage box.
Figure 8:
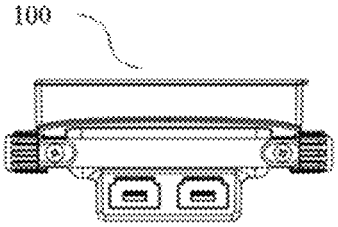
FIG. 8 is an illustrated front view in folded form of an exemplary foot care apparatus 100.
Figure 9:
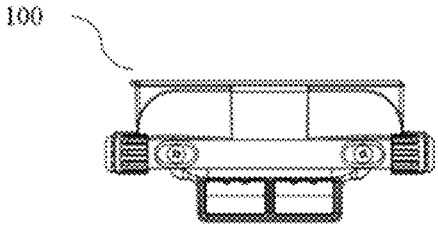
FIG. 9 is an illustrated rear view in folded form of an exemplary foot care apparatus 100.
Figure 10:
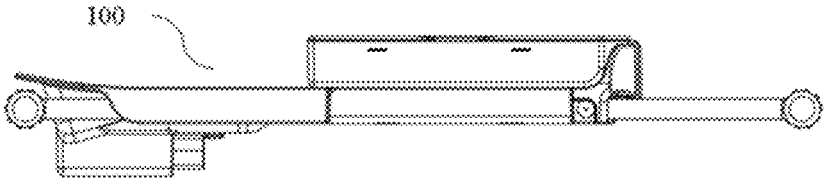
FIG. 10 is an illustrated right view in folded form of an exemplary foot care apparatus 100.
Figure 11:
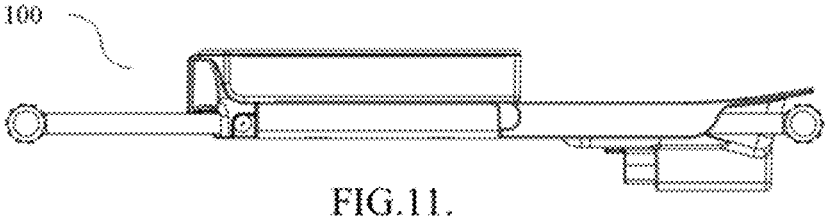
FIG. 11 is an illustrated left view in folded form of an exemplary foot care apparatus 100.
Figure 12:
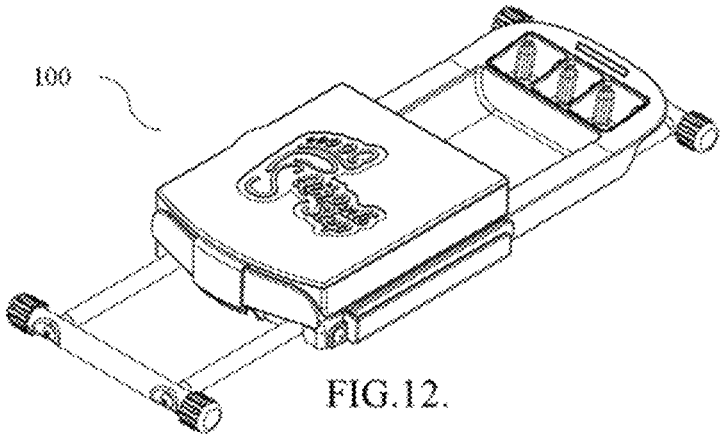
FIG. 12 is an illustrated isometric view in folded form of an exemplary nail and foot care apparatus 100.

Referring to FIG. 1, FIG. 2 and FIG. 3, the top 303 of the footrest 300 further comprises the longitudinal grooves or slots, 330 and 340, on both the sides, along the edges, extending from first end 301 to second end 302, configured store or hold the foot maintenance/pedicure tools like nail clippers, files, scissors, and so forth.

Some of the popular nail grooming tools, for proper maintenance are Nail Clippers, Nail Scissors, Nail nippers, Nail files, Nail Tweezers, Cuticle Scissors, Cuticle Nipper, Cleaners/brushes, Nail knife or Scrapper.

Side grooves 330 and 340 are an extension of the footrest to provide easy access to pedicure tools during the nail and footcare process. The grooves are wide enough to hold commonly used foot maintenance.

In one of the embodiments the slots 330 and 340 are closed at the first end 301 and opening at the second end 302 of the footrest 300, to accommodate an extension of tools beyond the lengths of the slots 330 and 340, which makes it possible to place multiple tools side by side as well as tools which are longer than the slot length. Further the closed end of the slot, prevents slippage of the tools, due to inherent tilt of the footrest 300.

Further in one of the embodiments, one or more openings 331 and 341 are provided at the bottom surface of the slots 330 and 340 of the footrest 300, configured to insert or slide the foot maintenance tools like nail clippers, files, scissors and so forth while managing the foot care activities.

The top 303 of the footrest 300 is preferably padded with one or more pads, 305 and 306. The one or more pads 305, 306 are provided on the footrest 300 along with curved, anti-slip lines, to hold the foot firmly and provide a cushioning comfort for the person. Further the pads avoid accidental movement or slippage of the foot.

The top 303 of the footrest 300 is configured to accommodate a foot of a person. A heel of the foot of the person is positioned to be substantially near the first end 301 of the footrest 300. Toes of the foot of the person is positioned to be substantially near the second end 302 of the footrest 300. The footrest 300 is tilted such that the first end 301 of the footrest 300 is at least closer to a ground or floor than the second end 302 of the footrest 300.

The bottom 304 of the footrest 300 is configured to fix one or more height adjusting device 350 and 351, close to the second end 302 of the footrest 300. The height adjusting device 350 and 351 comprises two or more groves. The height adjusting devices 350 and 351 are fixed parallel to each other, at a distance less than the length of the top brazing 213 of the first leg set 210, to avoid the interference of the intersection point of brazing 213 and the legs 210L and 210R of the first leg set 210. Further the groves of both the height adjusting devices 350 and 351 are aligned to be on the same line and configured to receive and hold the brazing 213 of the first leg set 210. Pacing the brazing 213, at the grooves, which are substantially closer to the second end 302 of the footrest 300, decreases the height and tilt of the footrest, on the other hand moving the brazing away from the second end 302 of the footrest, increase the tilt and the height of the footrest and vice versa.

In one of the embodiments, two height adjustable devices 350 and 351 are provided in the footrest 300 of the nail and foot care apparatus 100.

The tray 400 of the nail and foot care apparatus 100, has a first end 401, a second end 402, a top 403 and a bottom 404. The first end 401 of the tray 400 has a female coupling tab 410, which is configured to removably couple with male coupling tab 310 of the footrest 300, creating continuous platform, extending from first end 301 of the footrest 300 to second end 402 of the tray 400 enabling the foot of the person to rest on footrest 300, extending the toe portion substantially on the top 403 of the tray 400.

The top 403 of the tray 400 further comprises a first inner space 421, a second inner space 422 and a third inner space 423. The first inner space 421 is substantially near the first end 401, configured to catch the nail and cuticle clippings, etc. The first inner space 421 of the tray 401 is configured such that, the toes part of the foot extends substantially above the first inner space, such that all nail or cuticle clippings, etc., falls within the first inner space.

In one of the embodiments of the present disclosure, the coupling tab 310 of the footrest 300, have one or more extended tabs configured to increase the overall length of the combination of footrest 300 and the tray 400, to accommodate the extra longer foot of the person, such that toes part of the foot is substantially above to first inner space 421 of the tray 400.

In other embodiments of the present disclosure, the coupling tab 310 of the footrest 300, and the coupling tab 410 of the tray 400, are configured to couple pivotally, such that, after the usage, the footrest 300 and tray 400 can be folded together, with top 303 of the footrest 300 and top 403 of the tray 400 facing each other. Person, making folded foot care device substantially compact and portable.

In another embodiment, the coupling arrangement of the footrest 300 and tray 400 is configured reduce the overall length of the length of the combination of footrest 300 and the tray 400, to accommodate the extra shorter foot of the person such that toes part of the foot is substantially above to first inner space 421 of the tray 400.

The first inner space 421 of the tray 400 of the stand apparatus 100 is preferably of box shape, however other shapes are hereby contemplated, including, but not limited to, cup, square, oval, trapezoidal, etc.

The second inner space 422 of the tray 400 is substantially near the second end 402, and between the first inner space 421 and the third inner space 423. The second inner space 422 further comprises one or more cosmetic container holders 424 configured to hold the containers or bottles of the nail grooming cosmetics, like nail polish, paint, thinner etc., Further the groves 424 are provided with one or more pads or grippers ribs 425 to accommodate bottles of different sizes and hold them firmly in upright position.

In one of the embodiments, three of the grooves 424 are provided in a nail and foot care apparatus 100.

The third inner space 423 of the tray 400 is substantially near the second end 402. The third inner space 423 is configured to hold the smart device like electronic gadgets like smart phone, tablets, mobile phone battery bank, etc., such the person can watch content playing on the display of the gadget. Further one or more pads or grippers ribs are provided to accommodate gadgets of different sizes and hold them firmly in an adjustable position for comfortable viewing of the screen or the display.

Referring to FIG. 2, The bottom 404 of the tray 400 is provided with one or more battery bank slot 521 to removably, insert one or more battery banks 520.

The one or more battery bank slots 521 are designed to securely hold the battery bank 520. Further the battery banks the slots 521 is provided with a one or more strategically designed ribs 522 per slot, so that the battery bank 520 do not slide back to the floor when the nail and foot care apparatus 100 is being used in tilted position.

The tray 400 of the nail and foot care apparatus 100 is preferably made of a hard-plastic material, however other materials are hereby contemplated, including, but not limited to, wood, such as oak, maple, pine, etc., metal, plastic, PVC, etc.

In one of the embodiments, two ribs 522 are provided per battery bank slot 521 of the tray 400.

In one of the embodiments, the foot care apparatus, 100 is provided with one or more battery banks 520. The battery bank 520, comprises one or more batteries. The battery bank 520 is further provided with one or more power outlets, to connect the electrical devices. The power outlet may be of any standard types, including, but not limited to any commercially available in the market, like, clip on type terminal, plug and socket type, slidable pins, different types of USB ports and so forth.

The outlets of the battery bank 520 are connected one or more electrical devices like light 530 and/or fan 540, and/or electric power tools for foot maintenance.

One or more battery banks 520 and one or more battery slots 521 are configured to removably and conveniently slide the battery bank 520 into the battery slots 521 over the ribs to replace batteries in the battery pack or to decouple/detach the tray 400 for cleaning.

The battery bank slot 521 of the nail and foot care apparatus 100 is preferably made of a hard-plastic material, however other materials are hereby contemplated, including, but not limited to, wood, such as oak, maple, pine, etc., metal, plastic, PVC, Silicone etc.

The storage box 510 of the nail and foot care apparatus 100, is provided for storing including, but not limited to pedicure tools like filer, nail cutter, cuticle cutter, light, and fan etc. Further storage box 510 is provide with a tab 511 configured to clips on to the heel rest 320 of the footrest 300. In one of the embodiments, the storage box 510 covers the entire space of the top 303 of the footrest 300, excluding the side slots 330 and 340. In one of the embodiment, the storage box may have one or more clip on tabs 511, which can clip on to inner walls of the slots 330 and 340, or may extend on to the one or more openings 331 or 341.

The storage box 510 of the nail and foot care apparatus 100 is preferably made of a hard-plastic material, however other materials are hereby contemplated, including, but not limited to, wood, such as oak, maple, pine, etc., metal, plastic, PVC, Silicone etc.

In one of the embodiments of the present disclosure for the nail and foot care apparatus 100, comprises a support stand 200 having a top end 201 and bottom end 202. The support stand 200 further comprises a first leg set 210 and the second leg set 220, where in the first leg set and second leg sets are configured hold the foot rest on top end 201 and rest on the floor or the flat surface on the at the bottom end 202, in open position, and fold ably reclining along with the foot rest 300 and tray 400, making the foot care apparatus, compact and portable.

The first leg set 210 has left leg 210L and right leg 210R, a first end 211 and a second end 212. The first end 211 of the first leg set 210 is configured to be rest on the flat surface like ground or the floor. with a bottom bracing 214, and a set of rubber soft pads on both end of the brazing 214 providing anti-skid facility on smooth surface. The second end 212 of the first leg set 210 is configured to be movably coupled on sides, substantially near the first end 301 of the footrest 300. The second end 212 of the first leg set 210 has a height/tilt adjusting coupling option, with a top bracing 213 coupling left leg 210L and the right leg 210R. The brazing 213 is configured to lock into grooves of a height adjustable devices 350 and 351 at the bottom 304 of the footrest 300 as shown in FIG. 2. There is more than one grove in the height adjustable devices 350 and 351. Equal no of groves is provided in both the height adjustable devices 350 and 351, in other word, deices 351 and 352 are symmetrical in design. The number of grooves in the height adjustable devices 350 and 351, that is the no of height positions of the first leg sets is preferably 5 positions, however other number of positions are hereby contemplated, including, but not limited to five (5), ten (10), etc.

The second leg set 220 has a has left leg 220L and right leg 220R first end 221 and a second end 222. The first end 221 of the second leg set 220 is configured to be rest on the flat surface like ground or the floor, with a bottom bracing 214, and a set of soft rubber pads 225 on both ends providing anti-skid facility on smooth surface. The second end 222 of the second leg set 220 is configured to be hingedly coupled substantially near the second end 302 of the of the footrest 300.

The first leg set 210 and second leg set 220, are pivotally coupled together by fasteners 231 and 232, to make a crossed leg system as shown in the FIG. 1. The hinged couplings is made substantially closure to, but above the mid points of the legs towards the second end 212 and 222. The first leg set 210 is placed on inner side of the second leg set 220 at the hinged cross coupling point.

As shown in FIGS. 8 to 14, the folded views of the nail and foot care apparatus 100, the first leg set 210 and second leg set 220 are foldable such that when being put into storage the leg sets become flat with the with footrest 300 and the tray 400.

Figure 13:
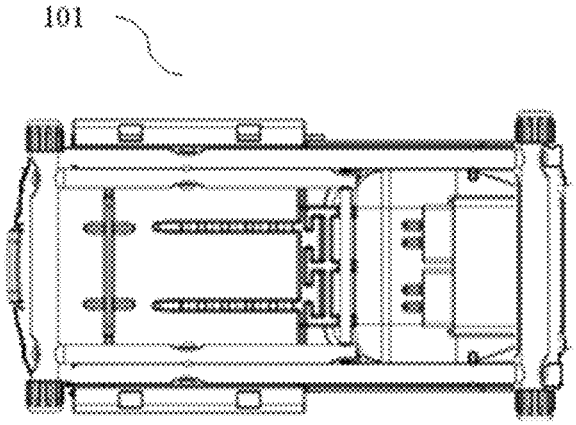
FIG. 13 is an illustrated rear view in folded form of an exemplary nail and foot care apparatus 100 with telescopic legs, with legs are not extended outside the footrest and tray.
Figure 14:
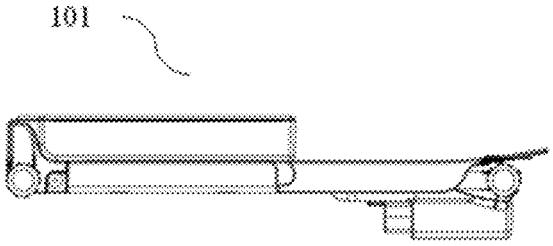
FIG. 14 is an illustrated side view in folded form of an exemplary nail and foot care apparatus 100 with telescopic legs, with legs are not extended outside the footrest and tray.

In one of the embodiments, the legs 210L, 210R, 220L and 220R are made up of telescopic rails, to further increase or decrease the height of the nail and foot care apparatus 100, to meet the individual needs, like too tall person or too short person and children. Further the telescopic railing design of legs 210L, 210R, 220L and 220R, enable the legs to recede within the overall lengths of the footrest 300 and tray 400, without extending outside as shown in FIGS. 13 and 14, for convenient storage. Further the telescopic legs may have one or more tabs to adjust and lock the height of the legs (Not shown in the drawings)

The first leg sets 210 and second leg set 220 is preferably made of a stainless-steel material, however other materials are hereby contemplated, including, but not limited to, wood, such as oak, maple, pine, etc., metal, plastic, PVC, etc.

In one of the embodiments the first leg set 210 is preferably taller than second leg set 220. The difference of the height of the first leg set 210 and the second leg set 220 configures an angle/tilt of the footrest 300 such that the toes of the person resting substantially near the second end 302 of the footrest 300 is higher and easier to reach than the heel of the foot of the person positioned to be substantially near the first end 301 of the footrest 300.

The angle of inclination is adjustable with position of the first leg set top brazing 213 with the groves in the height adjustable device 350 and 351. As the brazing 213 moves closer to second end 302 of the foot platform 300 along the height adjustable device 350 and 351 the angle or the slope of the foot platform decreases, and as the brazing 213 moves away from the second end 302 of the footrest 300, the angle or the slop of the footrest platform 300 increases, and vice versa. The height and the angle of the footrest 300 can be adjusted as per the comfort of the individual.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

The light 530 and the Fan 540, are portable and have a gooseneck, with power connect port at one end, enabling to flexibly adjust to focus on the specific pedicure area. The light 530 and fan 540 can be removed from the battery bank and stored in the storage box when not in use.

In one of the embodiments, the side storage slots 330, 340 of the foot rest 300, the inners spaces 422 and 423 inner spaces of the tray 400 can be used for holding treatment tools and medicine and inner space 421 for disposal of wastes while treating the foot and leg of the patient in the clinics and hospitals.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate (e.g., being part of furniture items, such as sofas, chairs, beds, etc., but not limited to these), without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A nail and foot care apparatus comprising:

a planar footrest, the footrest having a footrest top, a footrest bottom, a first footrest end, a second footrest end, a footrest top, one or more coupling tabs at the second footrest end and a pair of side slots having inner walls, wherein the footrest top of the footrest is configured to hold a heel of a foot substantially near the first footrest end of the footrest, supported by a heel rest, wherein toes of the foot are substantially near the second footrest end of the footrest, the footrest bottom is configured to hold a height adjusting device having one, or more grooves, and the side slots are configured to hold pedicure tools and cosmetic materials, the height adjusting device including at least two grooves fixed parallel to each other;

a planar tray, the tray having a tray top, a tray bottom, a first tray end, a second tray end and one or more coupling tabs at the first tray end, wherein the tray top of the tray has a first inner space, a second inner space, and a third inner space, and the first inner space is configured to catch nail and cuticle clippings, the second inner spare is configured to hold cosmetic containers, the third inner space is configured to hold at least one electronic gadget, and the tray bottom is configured to hold at least one battery bank slot; the battery bank slot is configured to hold at least one battery bank;

wherein the second footrest end of the footrest is removably coupled to the first tray end of the tray, with said one or more coupling tabs of the respective footrest and the tray, creating a continuous and integrated platform, the footrest and the tray fixed in a coplanar and non-sliding relationship to each other;

a support stand, the support stand having a top end, a bottom end, a first leg set and a second leg set, wherein the bottom end is configured to rest on a flat surface, the top end is configured to adjustably hold the footrest with the at least two grooves of the height adjusting device receiving and holding the top end of the first leg set and the second leg set, and wherein the first leg set has a height adjustable coupling with the height adjusting device of the footrest, wherein the second leg set is pivotally coupled to the footrest, further the first leg set and the second log set are hingedly coupled together, to render the log support stand crossed and foldable and hold the footrest firmly on the surface;

a storage box detachably attached to the footrest top of the footrest, the storage box is limited to a size of the footrest and covers an entire space of the footrest top of the footrest, excluding the pair of side slots, and is sized and configured to store the pedicure tools and cosmetic materials, the storage box configured to removably couple to the footrest using a clip-on mechanism, the clip-on mechanism having at least one clip on tab configured to engage the inner walls of the pair of slots;

at least one battery bank, the battery bank having one or more power outlets and configured to power the light, fan and electric tools, the battery bank removably inserted into the battery bank slot at the tray bottom of the tray.

2. The nail and foot care apparatus of claim 1, wherein, the side slots are provided with one or more openings to insert some of the pedicure tools and cosmetic materials for easy access while maintaining the foot.

3. The nail and foot care apparatus of claim 1, wherein the second footrest end of the footrest is removably coupled to the first tray end of the tray such that the nail and cuticle clippings fall in the first inner space of the tray, which first inner space is cleanable by decoupling the tray from the footrest.

4. The nail and foot care apparatus of claim 1, wherein the one or more coupling tabs provided at the second footrest end of the footrest and the first tray end of the tray are adjustable to change the overall combined length of the footrest and the tray, to accommodate feet of different lengths.

5. The nail and foot care apparatus of claim 1, wherein the second inner space is provided with one or more cosmetic holder spaces with a flexible gripper rib, configured to hold cosmetic containers of different sizes, firmly and upright.

6. The nail and foot care apparatus of claim 1, wherein the first leg set is taller than the second leg set, creating an inherent tilt of the footrest, enabling easy access to toes of the foot, the second footrest end of the footrest being at a greater height than the first footrest end of the footrest.

7. The nail and foot care apparatus of claim 1, wherein the first leg set and the second leg set are each of telescopic design, configured for additional height and tilted adjustment when in use, and reclined to shorter length in storage position, making the nail and foot care apparatus compact and easy to transport.

8. The nail and foot care apparatus of claim 1, wherein the one or more grooves are provided in one or more height adjusting devices are configured to adjust both the height and tilt of the footrest, when the first leg brazing is being moved from one grove to another of the height adjusting devices.

9. The nail and foot care apparatus of claim 1, wherein the battery bank slot is provided with one or more ribs, to hold the battery bank firmly, so that the battery bank does not slide back to the floor when the nail and foot care apparatus is being used.

10. The nail and foot care apparatus of claim 1, wherein the battery bank is provided with one or more power outlets to supply the power to the light, fan and electric powered pedicure tools.

11. The nail and foot care apparatus of claim 1, where in the second footrest end of the footrest is optionally, pivotally coupled with the first tray end of the tray, enabling the footrest and the tray foldable, during storage.

12. The nail and foot care apparatus of claim 1, wherein the heel rest is optionally pivotably connected with the first footrest end of the footrest and the heel rest is optionally foldable.

13. A nail and foot care apparatus comprising:

a planar footrest having a first footrest end and a second footrest end, the footrest configured to hold a heel of a foot;

a planar tray having a first tray end and a second tray end, the second footrest end of the footrest coupled to the first tray end of the tray, the tray having at least one inner space configured to hold pedicure tools and cosmetic materials;

wherein the footrest and the tray create a continuous and integrated platform, the footrest and the tray fixed in a coplanar relationship to each other in the platform;

a foldable support stand configured to rest on a flat surface and adjustably hold the footrest; and at least one battery bank supported by the tray, the at least one battery bank configured to power at least one of the pedicure tools.

14. The nail and foot care apparatus of claim 13, wherein the footrest comprises a pair of longitudinal grooves or slots extending from the first footrest end to the second footrest end of the footrest.

15. The nail and foot care apparatus of claim 12, wherein the grooves or slots are closed at the first footrest end and open at the second footrest end of the footrest to accommodate an extension of pedicure tools beyond the lengths of the grooves or slots.

16. The nail and foot care apparatus of claim 13, further comprising male and female coupling tabs coupling the second footrest end of the footrest with the first tray end of the tray.

17. The nail and foot care apparatus of claim 13, wherein the support stand comprises a top end, a bottom end, a first leg set and a second leg set, wherein the bottom end is configured to rest on a flat surface, the top end is configured to adjustably hold the footrest, the second leg set is pivotally coupled to the footrest, and the first leg set and the second leg set are hingedly coupled together to render the support stand foldable.

18. A nail and foot care apparatus comprising:

a planar footrest having a first footrest end, a second, footrest end, a footrest top, a footrest bottom, and footrest sides extending along the footrest top and the footrest bottom from the first footrest end to the second footrest end, the footrest top configured to hold a heel of a foot;

a pair of longitudinal grooves or slots extending along and parallel to the footrest sides, respectively, from first footrest end to the second footrest end of the footrest alongside the footrest top and the footrest bottom, the grooves or slots configured to hold pedicure tools and cosmetic materials, the pair of slots having inner walls;

a planar tray having a first tray end and a second tray end, the second footrest end of the footrest coupled to the first tray end of the tray, the tray having at least one inner space configured to hold pedicure tools and cosmetic materials, the tray having at least one battery bank slot;

wherein the footrest and the tray create a continuous and integrated platform, the footrest and the tray fixed in a coplanar relationship to each other in the platform;

a foldable support stand configured to rest on a flat surface and adjustably hold the footrest;

at least one battery bank removably inserted into the at least one battery bank slot in the tray, the at least one battery bank configured to power at least one of the pedicure tools; and a storage box detachably attached to the footrest top of the footrest, the storage box sized and configured to store at least one of the pedicure tools and cosmetic materials, the storage box configured to detachably engage the inner walls of the pair of slots.

19. The nail and footcare apparatus of claim 18 wherein the storage box is configured to removably couple to the footrest using a clip-on mechanism, the clip-on mechanism having at least one clip on tab configured to engage the inner walls of the pair of slots.

* * * * *